US006258502B1

(12) United States Patent
Nakamura et al.

(10) Patent No.: US 6,258,502 B1
(45) Date of Patent: Jul. 10, 2001

(54) TWO-COMPONENT DEVELOPER, TWO-COMPONENT DEVELOPER HOLDING CONTAINER, AND ELECTROPHOTOGRAPHIC IMAGE FORMATION APPARATUS EQUIPPED WITH THE CONTAINER

(75) Inventors: Yasushi Nakamura; Noboru Kuroda; Ryoichi Ito; Yasuaki Iwamoto; Kohki Katoh; Yoshihiro Sugiyama; Kenichi Uehara; Tomio Kondou, all of Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/579,133

(22) Filed: May 30, 2000

(30) Foreign Application Priority Data

May 28, 1999 (JP) ..... 11-150087

(51) Int. Cl.[7] ..... G03G 9/097; G03G 9/083
(52) U.S. Cl. ..... 430/106.6; 430/110; 399/262
(58) Field of Search ..... 430/106.6, 110, 430/111; 399/262

(56) References Cited

U.S. PATENT DOCUMENTS

| | | | |
|---|---|---|---|
| 4,980,258 | 12/1990 | Aoki et al. | 430/110 |
| 5,225,303 | 7/1993 | Tomita et al. | 430/106.6 |
| 5,380,616 | 1/1995 | Aoki et al. | 430/110 |
| 5,840,456 | 11/1998 | Tomita et al. | 430/106 |
| 6,165,663 * | 12/2000 | Baba et al. | 430/106.6 |
| 6,183,926 * | 2/2001 | Kuroda et al. | 430/106.6 |

FOREIGN PATENT DOCUMENTS

| | | |
|---|---|---|
| 0 330 498 | 8/1989 | (EP) . |
| 0 541 113 | 5/1993 | (EP) . |
| 0 606 930 | 7/1994 | (EP) . |
| 0 780 734 | 6/1997 | (EP) . |
| 0 997 786 | 5/2000 | (EP) . |

* cited by examiner

*Primary Examiner*—John Goodrow
(74) *Attorney, Agent, or Firm*—Oblon, Spivak, McClelland, Maier & Neustadt, P.C.

(57) ABSTRACT

A two-component developer includes a magnetic carrier including magnetic carrier particles with an average particle diameter of 35 $\mu$m to 100 $\mu$m, and a toner including toner particles with a weight-average particle diameter of 6.0 $\mu$m to 11.5 $\mu$m, to which at least one additive is externally added thereto in an amount of 0.3 to 1.5 wt. % to the toner, the toner particles including (a) toner particles with a particle diameter of 5 $\mu$m or less with a content ratio of 15% or less by number, and (b) toner particles with such a particle diameter that is two times or greater than the weight-average particle diameter of the toner particles with a content ratio of 5% or less by volume, the toner particles satisfying a relationship of $0.60 \leqq D25/D75 \leqq 0.85$ as defined in the specification. A container in which the two-component developer is contained, and an electrophotographic image formation apparatus in which the container is incorporated are proposed.

13 Claims, 6 Drawing Sheets

TWO-COMPONENT DEVELOPER, TWO-COMPONENT DEVELOPER HOLDING CONTAINER, AND ELECTROPHOTOGRAPHIC IMAGE FORMATION APPARATUS EQUIPPED WITH THE CONTAINER

BACKGROUND OF THE INVENTION

1. Field of the Invention

The present invention relates to a two-component developer for developing latent electrostatic images to visible toner images for use in an image formation method by electrophotography or by electrostatic image printing. The present invention also relates to a container in which the two-component developer is held, and to an electrophotographic image formation apparatus equipped with the container.

2. Discussion of Background

In electrophotography, a latent electrostatic image is formed on a photoconductor comprising a photo-conductive material, using various means, and the formed latent electrostatic image is developed with a toner to a visible toner image, and when necessary, the developed toner image is then transferred to a sheet of paper and fixed thereon with the application of heat and/or pressure thereto, or by use of the vapor of a solvent, whereby a hard copy can be obtained.

As disclosed in Japanese Laid-Open Patent Application 61-147261, the methods of developing the latent electrostatic image are broadly classified into two methods, namely a method using a two-component developer which is a mixture of a toner and a carrier, and a method using a mono-component developer consisting of a toner, which may be simply referred to a toner, without the carrier being mixed therewith.

In the method using the two-component developer, the toner is mixed with the carrier, and the mixture is stirred, so that the toner may become triboelectrically charged to a polarity opposite to that of the carrier. An electrostatic image with the opposite polarity to that of the charged toner is developed with the charged toner to a visible toner image. Depending upon the kinds of toner and carrier used, various methods are known, for example, a magnetic-brush development method using an iron powder carrier, a cascade development method using a bead carrier, and a fur-brush development method using a fur brush. The toner for use in the above-mentioned various development methods comprises finely-divided toner particles, each toner particle comprising a binder resin such as a natural resin or a synthetic resin, and a coloring agent such as carbon black dispersed in the binder resin.

For example, there can be used as the toner such particles that are obtained by dispersing a coloring agent in a binder resin such as polystyrene, and pulverizing the coloring-agent-dispersed binder resin to finely-divided particles having a particle diameter of about 1 to 30 $\mu$m.

Furthermore, the above-mentioned toner can also be used as a magnetic toner by containing therein a magnetic material such as magnetite.

Recent consumer demand for copying machines and printers on the market is always higher speed and more stabilized operation. Currently the method using the two-component developer is mainly used in high speed copying machines or high speed printers.

This is because the two-component developer is capable of providing images with better quality in a stable manner than the one-component developer, although the two-component developer has the drawbacks that the carrier easily deteriorates and the mixing ratio of the toner and the carrier is changeable, and that it is difficult to perform the maintenance of a development apparatus using the two-component developer and to make the apparatus compact in size. Furthermore, the two-component developer does not contain such a large amount of a magnetic material therein as in a one-component magnetic toner, so that the two-component developer is extremely advantageous over the one-component developer in image fixing performance in high speed copying machines and printers.

In the development method using the two-component developer, which is hereinafter referred to as the two-component development system, cleaning means, such as a blade or a fur brush, for cleaning a latent image bearing member by removing residual toner particles therefrom after image transfer is carried out, is generally employed in direct contact with the latent image bearing member. As a matter of course, during such cleaning, the above-mentioned cleaning member or a development member comes into direct contact with a charge transport layer (CTL) on the surface of the latent image bearing member, and therefore the charge transport layer (CTL) is abraded.

In particular, the photoconductor for use in the high-speed copying or high-speed printing apparatus is required to have a sufficient abrasion resistance for making a large number of copies or printings. For this reason, the combination of an organic photoconductor in the form of a flexible belt which has a large available surface area, and a cleaning brush capable of performing relatively moderate soft touch cleaning for the photoconductor has become the mainstream in the high-speed copying or printing apparatus. However, even though such combination is adopted, the resistance is not always sufficient for making an extremely large number of copies or printings, for example, more than one million, by the high-speed copying or printing apparatus, so that still more improved durability is desired with respect to the photoconductor.

With respect to the quality of hard copy image, the improvement of preciseness and resolution is strongly desired in recent years. However, conventional developers have the drawback that the resolution of the developed image is lowered in the course of making large quantities of copies and printings for an extended period of time since toner particles are selectively consumed in the development and the particle size distribution of the toner particles in the developer changes with time in the course of the development.

In order to obtain toner images with high preciseness and high resolution by the above development system, various developers are proposed, as disclosed in Japanese Laid-Open Patent Applications 1-112253, 2-284158 and 7-295283. Each of the above-mentioned developers comprise toner particles with a small average particle diameter, in which the content of toner particles with a particle diameter of 5 $\mu$m or less, and the particle size distribution of the toner particles are particularly specified.

The toner particles with a particle diameter of 5 $\mu$m or less constitute an indispensable toner component for forming a toner image with high preciseness and high resolution. It is considered that when the toner particles with a particle diameter of 5 $\mu$m or less are constantly supplied to a latent electrostatic image formed on the photoconductor in the development step, the latent electrostatic image can be accurately developed to a toner image with excellent reproducibility.

However, the toner particles with a particle diameter of 5 μm or less produce the problem of causing a conspicuous reduction in image density. More specifically, the reduction in image density is considered to be caused because the intensity of the electric field is greater in the edge portion of a latent image than in the central portion thereof, so that the toner particles tend to be less deposited in the central portion of the latent image than in the edge portion and accordingly the image density is smaller in the central portion than in the edge portion when the above-mentioned toner particles with a particle diameter of 5 μm or less are employed However, it is conventionally supposed that this problem could be solved by controlling the content ratio by number of toner particles with a particle diameter of more than 5 μm, which are referred to as the toner particles with an intermediate particle diameter.

The finer the particle diameter of the toner, the more advantageous for obtaining images with high preciseness and high resolution.

As shown in FIGS. 1 and 2, a toner which comprises toner particles with a particle diameter of 5 μm or less in an amount of 17% by number contains the toner particles with a particle diameter of 5 μm or less in an amount of 3 vol. %. When the toner particles with a particle diameter of 5 μm or less are present in such a small amount, it is difficult to consider that the toner particles with a particle diameter of 5 μm or less are selectively deposited on the edge portion of a latent electrostatic image, and the toner particles with a particle diameter of 5 μm or more, that is, with an intermediate particle diameter, are selectively deposited on the central portion of the latent electrostatic image.

In contrast to the above, as shown in FIGS. 3 and 4, in the case of a toner which comprises toner particles with a particle diameter of 5 μm or less in an amount of 60% by number, excessive charging, which is referred to as "charge-up", is apt to take place, in particular, at low humidities. The thus charged up toner particles or other fine particles are firmly deposited on the surface of carrier particles or on the surface of a photo-conductor. The result is that there occur various problems, such as lowering of image density, the occurrence of fogging in image, improper cleaning of the photoconductor, and the filming of the toner on the surface of the photoconductor.

Japanese Laid-Open Patent Application 4-1773 discloses a toner comprising toner particles with a particle diameter of 12.7 to 16.0 μm in an amount of 0.1 to 5.0 vol. % in order to improve the fluidity of the toner, thereby solving the above-mentioned problems. In this case, however, the obtained fluidity of the above-mentioned toner is in fact inferior to that of the toner comprising the toner particles with a particle diameter 5 μm or less in an amount of 15% or less by number.

The fluidity of the toner can also be improved by increasing the amount of a fluidity improving agent to be added thereto. It is considered that approximately the same fluidity can be obtained when the fluidity improving agent is present on the surface of toner particles in the same state, so that it is obvious that, in order to obtain substantially the same fluidity in (a) the toner comprising the toner particles with a particle diameter of 5 μm or less in an amount of as much as 60% by number, and in (b) the toner comprising the toner particles with a particle diameter of 5 μm or less in an amount of 17% by number, it is required that the fluidity improving agent be added to the former toner in an amount of 1.5 to 2.0 times the amount of the fluidity improving agent required for the latter toner.

However, when such a large amount of the fluidity improving agent is added to the toner, the contamination of the photoconductor with the fluidity improving agent, the occurrence of the above-mentioned filming problem, and the deterioration of image fixing performance will become obviously unavoidable.

Japanese Laid-Open Patent Applications 4-124682 and 10-91000 propose mono-component developers in which the number of the toner particles with a particle diameter of 5 μm or less is significantly reduced, and disclose the effects thereof. However, nothing is mentioned about the particle size distribution of the majority of toner particles by which image quality is dominantly determined. It was found that toner images with high resolution cannot be obtained by the mono-component developers disclosed in the above-mentioned references.

SUMMARY OF THE INVENTION

It is therefore a first object of the present invention to provide a two-component developer which has excellent fluidity with the addition of a small amount of an additive agent and excellent image fixing performance, and is substantially free of the above-mentioned conventional problems of the contamination of a photoconductor therewith and the filming thereof.

The second object of the present invention is to provide a two-component developer for use in an image formation method, in which there is used cleaning means for removing a residual toner from a latent image bearing member after image transfer therefrom.

The third object of the present invention is to provide a container in which the above two-component developer is held.

The fourth object of the present invention is to provide an electrophotographic image formation apparatus in which the two-component developer holding container is incorporated.

The first object of the present invention can be achieved by a two-component developer comprising at least a magnetic carrier and a toner wherein the magnetic carrier comprises magnetic carrier particles with an average particle diameter of 35 μm to 100 μm, and the toner comprises toner particles with a weight-average particle diameter of 6.0 μm to 11.5 μm, to which at least one additive is externally added thereto in an amount of 0.3 to 1.5 wt. % to the toner, the toner particles comprising (a) toner particles with a particle diameter of 5 μm or less with a content ratio of 15% or less by number, and (b) toner particles with such a particle diameter that is two times or greater than the weight-average particle diameter of the toner particles with a content ratio of 5% or less by volume, the toner particles satisfying a relationship of $0.60 \leqq D25/D75 \leqq 08.5$, wherein D25 is a number-average particle diameter when the toner particles reach a cumulative particle number of 25% in a cumulative undersize particle number distribution thereof, and D75 is a number-average particle diameter when the toner particles reach a cumulative particle number of 75% in a cumulative undersize particle number distribution.

In the above-mentioned two-component developer, the additive may comprise at least one component selected from the group consisting of silica particles, titania particles, and alumina particles.

Furthermore, in the above-mentioned two-component developer, the toner may comprise toner particles with a weight-average particle diameter of 7.5 μm to 10.5 μm, the toner particles comprising (a) the toner particles with a particle diameter of 5 μm or less with a content ratio of 15% or less by number, and (b) the toner particles with such a particle diameter that is two times or greater than the weight-average particle diameter of the toner particles with a content ratio of 3% or less by volume, the toner particles satisfying a relationship of $0.70 \leqq D25/D75 \leqq 0.85$.

In the above-mentioned two-component developer, it is preferable that the silica particles have a BET specific surface area of 20 $m^2/g$ to 200 $m^2/g$.

In the above-mentioned two-component developer, it is also preferable that the titania particles have a BET specific surface area of 30 $m^2/g$ to 210 $m^2/g$.

In the above-mentioned two-component developer, it is also preferable that the alumina particles have a BET specific surface area of 40 $m^2/g$ to 220 $m^2/g$.

The second object of the present invention can be achieved by the above-mentioned two-component developer.

The third object of the present invention can be achieved by a container in which there is held the above-mentioned two-component developer.

The fourth object of the present invention can be achieved by an electrophotographic image formation apparatus in which the above-mentioned container is incorporated.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
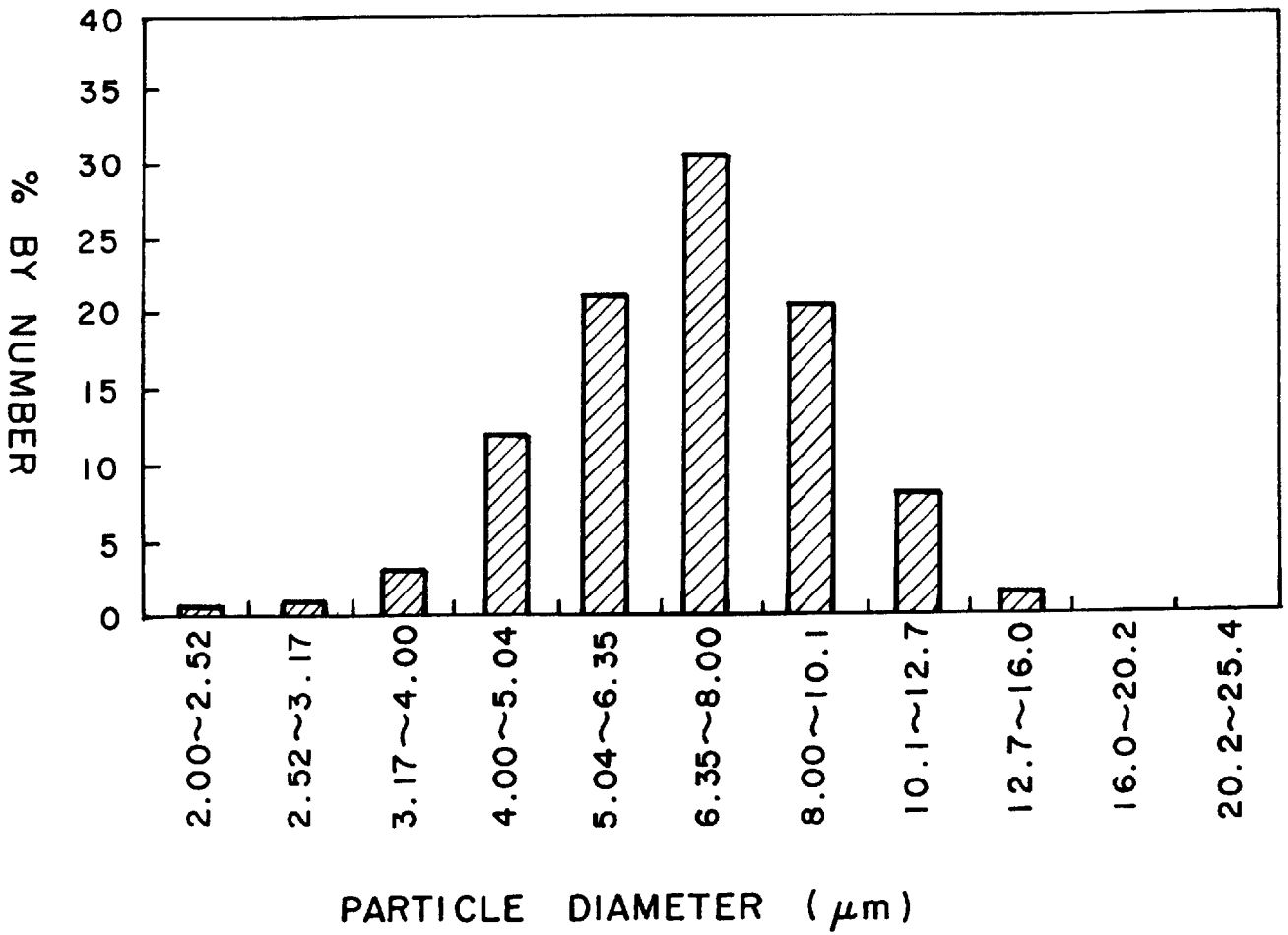
FIG. 1 is a graph showing a number particle size distribution of an example of a conventional toner which contains toner particles with a particle diameter of 5 $\mu$m or less in an amount of 17% by number.
Figure 2:
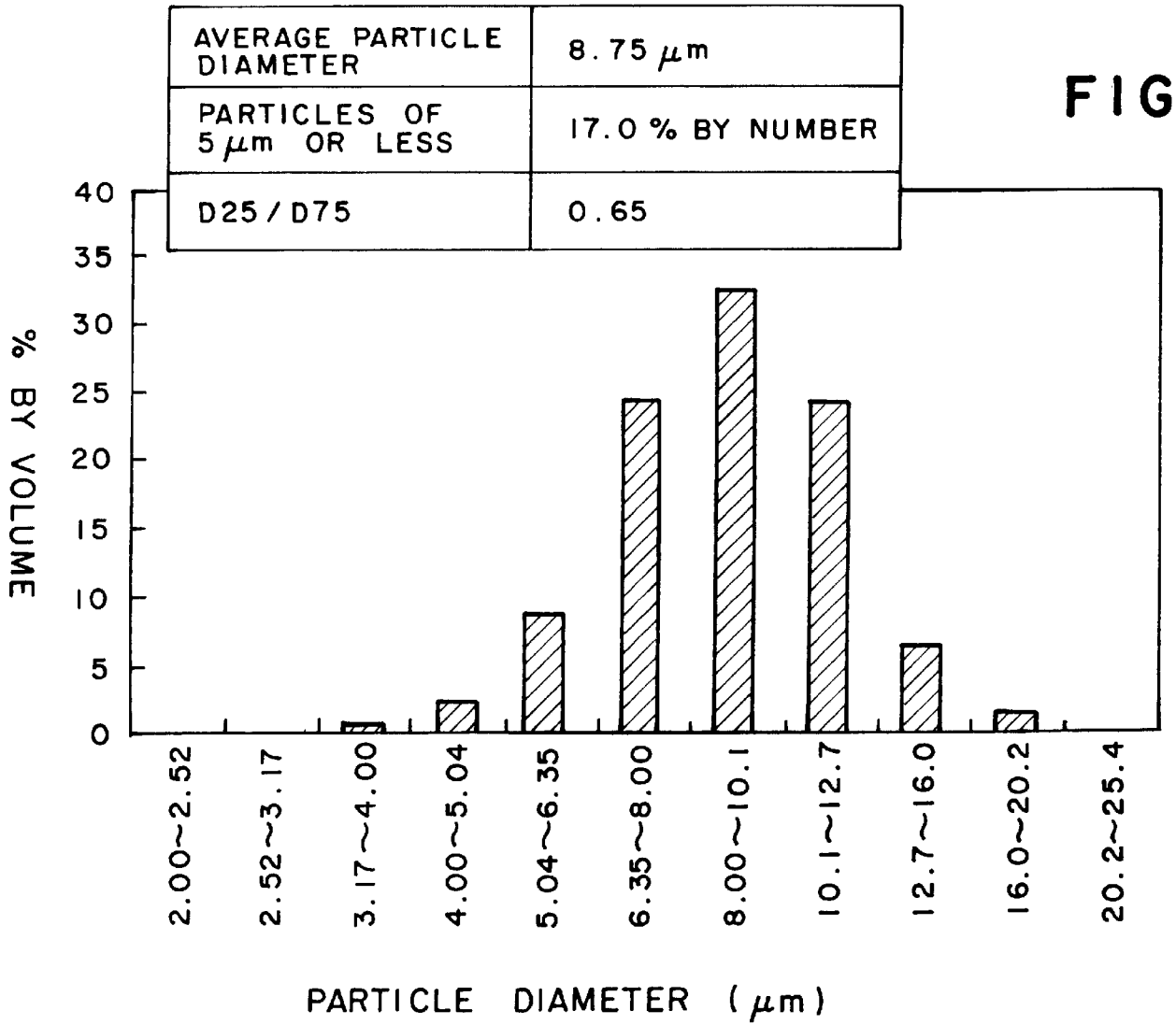
FIG. 2 is a graph showing a volume particle size distribution of the conventional toner which contains toner particles with a particle diameter of 5 $\mu$m or less in an amount of 17% by number.
Figure 3:
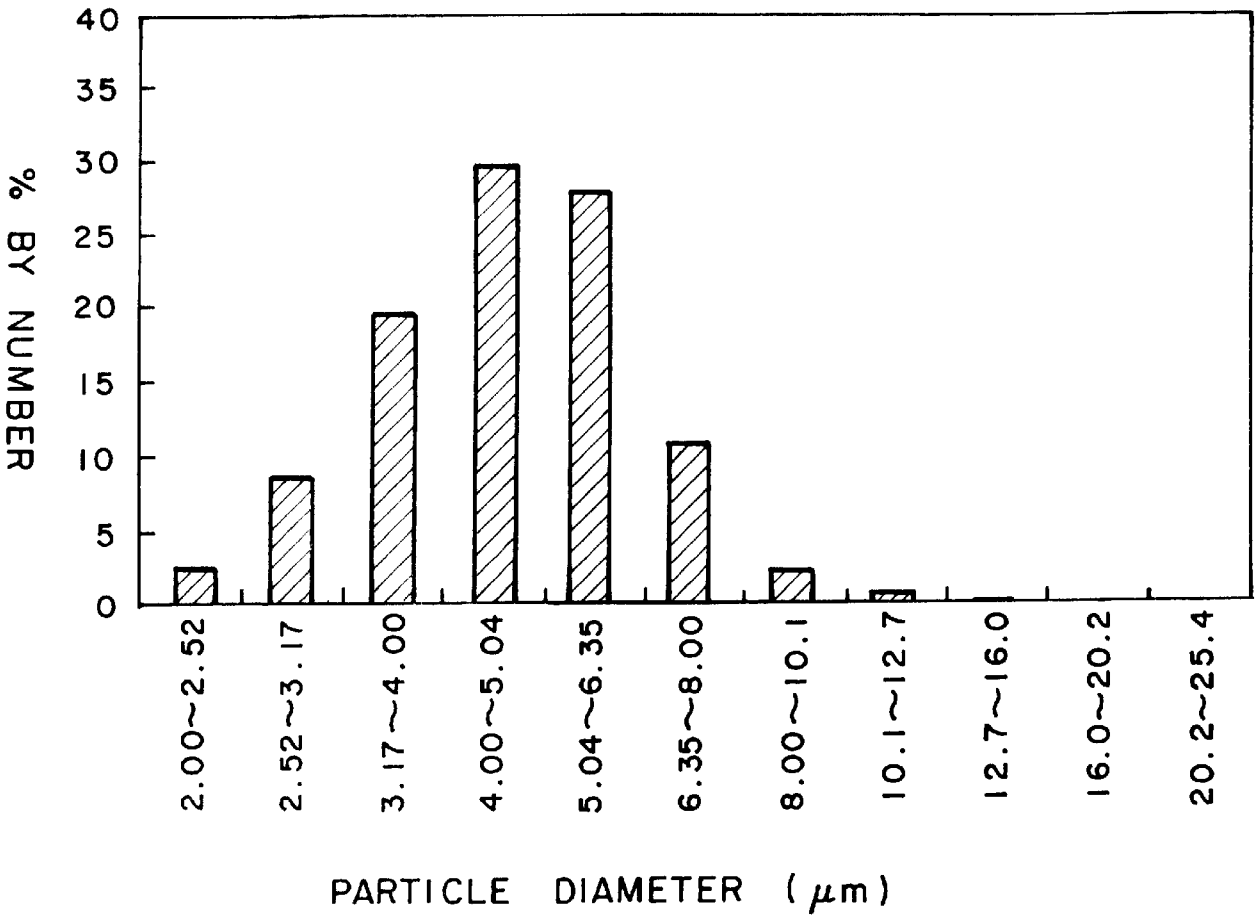
FIG. 3 is a graph showing a number particle size distribution of another example of a conventional toner which contains toner particles with a particle diameter of 5 $\mu$m or less in an amount of 60% by number.
Figure 4:
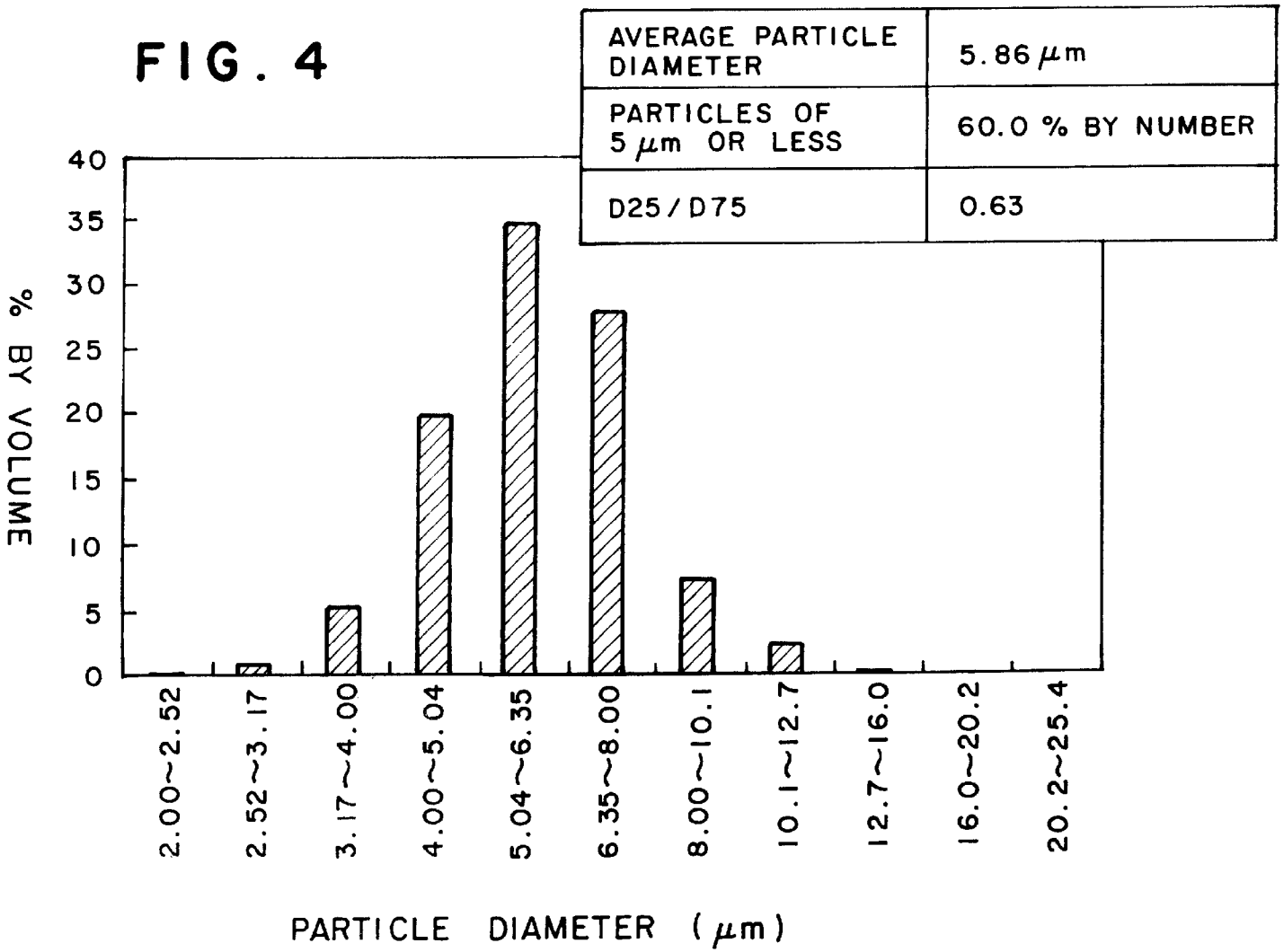
FIG. 4 is a graph showing a volume particle size distribution of the conventional toner which contains toner particles with a particle diameter of 5 $\mu$m or less in an amount of 60% by number.
Figure 5:
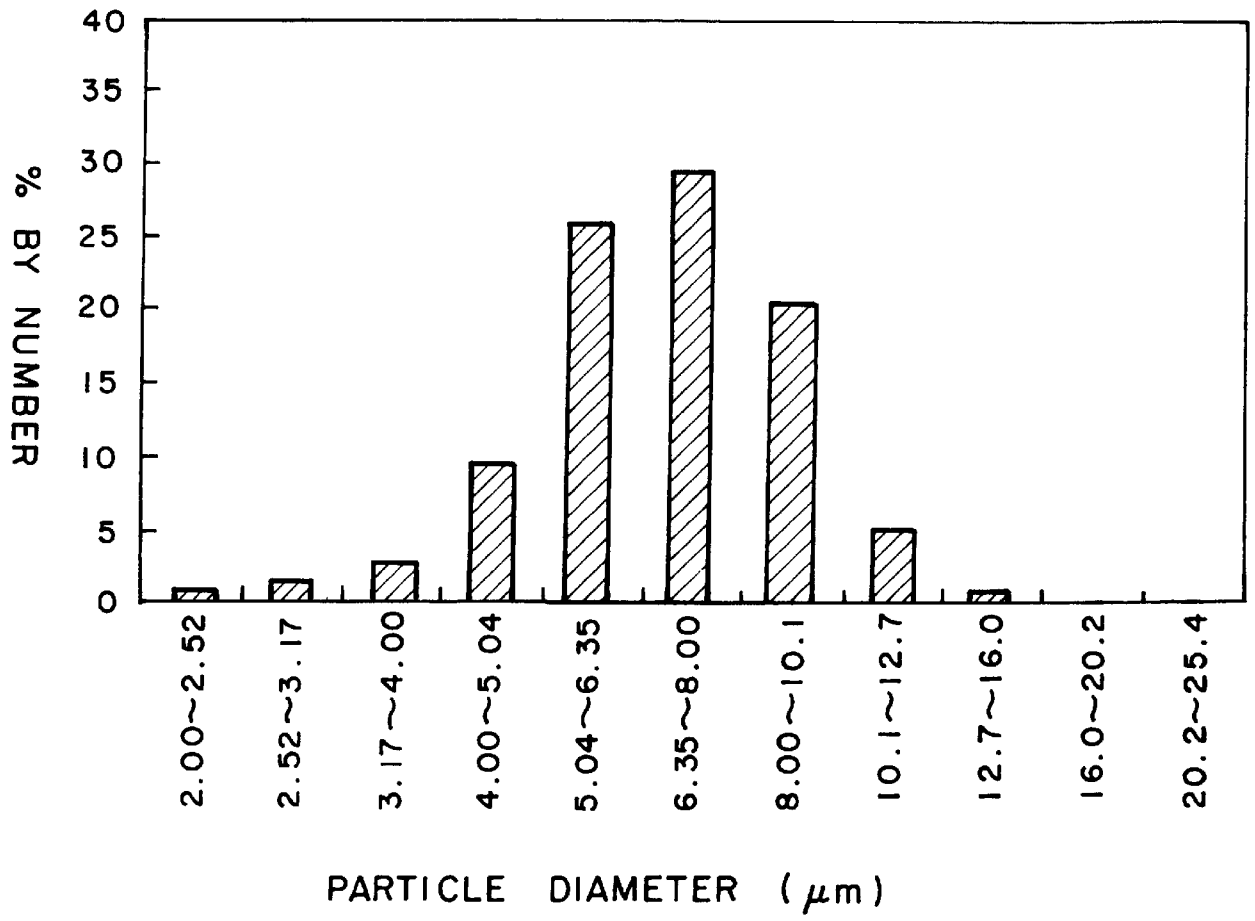
FIG. 5 is a graph showing a number particle size distribution of a representative example of a toner for use in the present invention.
Figure 6:
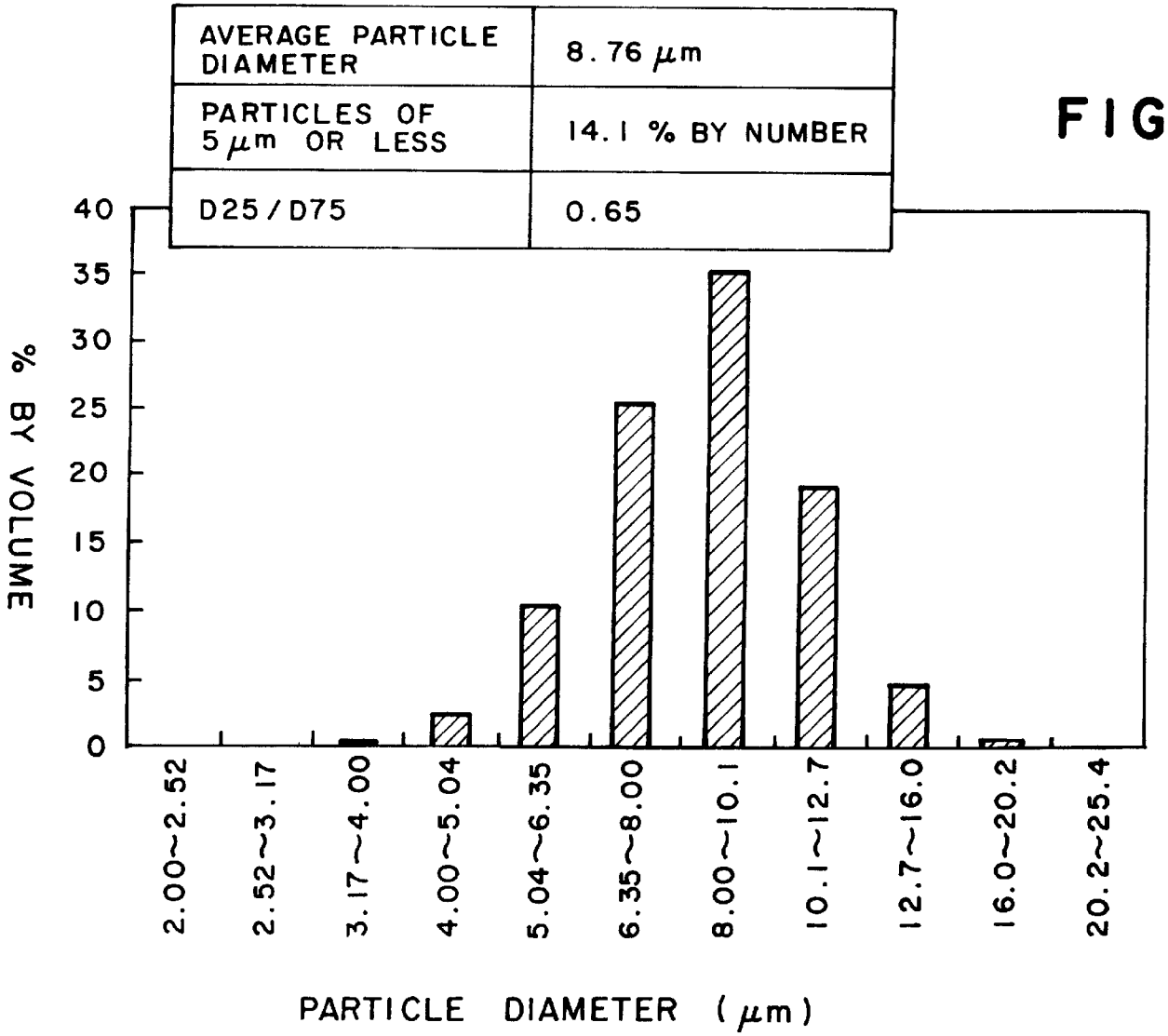
FIG. 6 is a graph showing a volume particle size distribution of the representative example of the toner for use in the present invention.

The two-component developer of the present invention comprises at least a magnetic carrier and a toner wherein the magnetic carrier comprises magnetic carrier particles with an average particle diameter of 35 $\mu$m to 100 $\mu$m, and the toner comprises toner particles with a weight-average particle diameter of 6.0 $\mu$m to 11.5 $\mu$m, to which at least one additive is externally added thereto in an amount of 0.3 to 1.5 wt. % to the toner, the toner particles comprising (a) toner particles with a particle diameter of 5 $\mu$m or less with a content ratio of 15% or less by number, and (b) toner particles with such a particle diameter that is two times or greater than the weight-average particle diameter of the toner particles with a content ratio of 5% or less by volume, the toner particles satisfying a relationship of $0.60 \leqq D25/D75 \leqq 0.85$, wherein D25 is a number-average particle diameter when the toner particles reach a cumulative particle number of 25% in a cumulative undersize particle number distribution thereof, and D75 is a number-average particle diameter when the toner particles reach a cumulative particle number of 75% in a cumulative undersize particle number distribution.

The two-component developer of the present invention which comprises the toner containing therein as the additive a hydrophobic treated inorganic powder in a predetermined amount, and the magnetic carrier comprising magnetic carrier particles, with the above-mentioned particle size distribution, has excellent fluidity even when the amount of the inorganic powder added is small, and is substantially free of the problems such as the contamination of the photoconductor with the toner and the filming of the toner, and the image fixing performance thereof is excellent. As a matter of course, even if a large number of copies or printings are continuously made by using the two-component developer, the high resolution and preciseness of the images made can be maintained. Furthermore, even when recycled paper is used, problems such as improper cleaning and toner filming are not caused, so that images can be formed in an extremely stable manner.

The reasons why the toner for use in the present invention exhibits the above-mentioned effects have not yet been clarified, but can be considered as follows;

One of the features of the toner for use in the present invention is that the toner comprises the toner particles with a particle diameter of 5 $\mu$m or less with a content ratio of 15% or less by number. The smaller the particle diameter of the toner particles of the toner, the more advantageous for obtaining image with high resolution and high preciseness. However, it is difficult to control the charge quantity of the toner particles with a particle diameter of 5 $\mu$m or less. Furthermore, the toner particles with a particle diameter of 5 $\mu$m or less constitute a component which impairs the fluidity of the toner, contaminates the photoconductor, and causes the problems of improper cleaning of the photoconductor and forming a film on the surface of the photoconductor. Furthermore, the toner particles with a particle diameter of 5 $\mu$m or less are apt to scatter and constitute such a component that makes dirty the inside of an image formation apparatus.

Furthermore, when an inorganic oxide is added to the toner to improve the fluidity of the toner, the smaller the particle diameter of the toner particles of the toner, the greater the surface area of the toner particles, so that in order to make the presence ratio of the inorganic oxide on the surface of the toner particles equal in both toner particles with a larger particle diameter and toner particles with a smaller particle diameter, a larger amount of the inorganic oxide has to be added to the toner particles with a smaller particle diameter than to the toner particles with a larger particle diameter. It has been confirmed that the addition of the larger amount of the inorganic oxide to the toner causes the contamination of the photoconductor with the toner and the filming of the toner.

More specifically, increasing the content ratio of the toner particles with a particle diameter of 5 $\mu$m or less in the toner has a good effect on the increasing of resolution. However, in the case where the toner is used in the two-component developer for an extended period of time, the above-mentioned problems cannot be solved and therefore no satisfactory results cannot be obtained.

Rather, by decreasing the content ratio of the toner particles with a particle diameter of 5 μm or less to 15% or less by number in the toner, a sufficient fluidity of the toner for use in practice can be secured with the addition of a small amount of a fluidity-improving agent thereto, the contamination of the photoconductor with the toner and the filming of the toner can be minimized, whereby a two-component developer with excellent image fixing performance can be provided.

Another feature of the toner for use in the present invention is that the toner particles thereof satisfies the relationship of $0.60 \leqq D25/D75 \leqq 0.85$, wherein D25 is a number-average particle diameter when the toner particles reach a cumulative particle number of 25% in a cumulative undersize particle number distribution thereof, and D75 is a number-average particle diameter when the toner particles reach a cumulative particle number of 75% in a cumulative undersize particle number distribution.

It is indicated that the closer to 1 the ratio of D25/D75, the sharper the particle size distribution of the toner particles in the range of 25% to 75% in the cumulative particle number distribution.

That the particle size distribution of the toner particles which substantially make most part of the image is sharp indicates that each toner particle has the same characteristics. In such a case, the behavior of each toner particle in the development unit is the same, so that selective consumption of particular toner particles and formation of toner particles with different charge quantities are reduced and when such a toner is used, images can be formed in a stable manner, with high preciseness and high resolution.

Furthermore, in the toner for use in the present invention, the toner particles with such a particle diameter that is two times or greater than the weight-average particle diameter of the toner particles are controlled to be in an amount of 5% or less by volume. The smaller the content of the toner particles with such particle diameter in the toner, the better.

Furthermore, by use of the above toner in combination with a magnetic carrier which comprises magnetic carrier particles with an average particle diameter of 35 μm to 100 μm, the charge quantity of each toner particle of the toner can be made more uniform.

Thus, the two-component developer of the present invention can solve the problems of conventional two-component developers and also can meet the keen demands for higher image quality, low-temperature image fixing, higher durability of the photoconductor for use in recent high speed image formation apparatus.

In the toner for the two-component developer of the present invention, the content ratio of the toner particles with a particle diameter of 5 μm or less is 15% or less by number in the total number of the toner particles of the toner as mentioned above, preferably 12% or less by number.

When the content ratio of the toner particles with a particle diameter of 5 μm or less is more than 15% by number in the total number of the toner particles of the toner, the average particle diameter of the toner particles of the toner is relatively decreased, and the decreased average particle diameter is advantageous for obtaining higher resolution, but impairs the fluidity of the toner, and causes the problems of improper cleaning of the photoconductor and the filming of the toner.

Furthermore, as mentioned above, in the toner for use in the present invention, the toner particles thereof satisfies the relationship of $0.60 \leqq D25/D75 \leqq 0.85$, preferably, $0.70 \leqq D25/D75 \leqq 0.85$.

When D25/D75 is smaller than 0.60, that is, when $D25/D75 < 0.60$, in the above-mentioned relationship, the particle size distribution becomes so broad that the behavior of each toner particle becomes non-uniform. As a result, it may occur that particular toner particles are selectively consumed and the toner particles are not charged uniformly, so that the image quality is impaired.

When D25/D75 is larger than 0.85, that is, when $D25/D75 > 0.85$, the particle size distribution is so sharp that it is better for obtaining a toner image with remarkably high resolution. However, the productivity of such toner particles is too extremely low to be adopted for use in practice when prepared by a conventional method using dry type pulverizing and classification.

Furthermore, in the present invention, the content of the toner particles with such a particle diameter that is two times or greater than the weight-average particle diameter of the entire toner particles is 5% or less by volume. It is preferable that the content of the toner particles with such a particle diameter that is two times or greater than the weight-average particle diameter of the entire toner particles be 3% or less by volume.

When the content of the toner particles with such a particle diameter that is two times or greater than the weight-average particle diameter of the entire toner particles exceeds 5% by volume, the reproduction of thin line images tends to be impaired.

The weight-average particle diameter of the toner particles of the toner of the present invention is in the range of 6.0 to 11.5 μm, preferably in the range of 7.5 to 10.5 μm.

When the weight-average particle diameter is less than 6.0 μm, there easily occur the problems that the inside of the image formation apparatus is made dirty by the scattering of the toner particles while in use for an extended period of time, the image density decreases at low humidities, and the photoconductor cannot be cleaned properly, while when the weight-average particle diameter exceeds 11.5 μm, the resolution of a minute spot with a diameter of 100 μm or less is not sufficient, and the toner particles are scattered onto a non-image area (background area), so that the image quality obtained tends to be lowered.

The magnetic carrier particles of the carrier for use in the present invention have an average particle diameter of 35 μm to 100 μm. When the average particle diameter of the carrier particles is in the above-mentioned range, and such carrier is used in combination with the above-mentioned toner for use in the present invention, with the content ratio of the toner being set in the range of 2 to 10 wt. % when used in a development unit, the toner particles of the toner can be charged with uniform charge quantity.

When the average particle diameter of the carrier particles is less than 35 μm, such carrier particles tend to be deposited on the surface of the photoconductor, and the stirring efficiency of the mixture of the toner and the carrier is lowered, so that it is difficult to charge the toner with uniform charge quantity in each toner particle.

When the average particle diameter of the carrier particles exceeds 100 μm, such carrier particles cannot charge the toner for use in the present invention sufficiently, so that it is difficult to charge the toner with uniform charge quantity in each toner particle.

The average particle diameter of the carrier particles can be measured by conventional screening. sieving method.

Alternatively, 200 to 400 carrier particles are selected by random sampling from a microphotographic image taken by an optical microscope, and subjected to an image processing analysis, using an image processing analyzer, whereby the average particle diameter of the carrier particles can be determined.

The particle size distribution of toner particles can be measured by various methods.

In the present invention, the particle size distribution of the toner particles of the toner is measured using a commercially available measuring apparatus "Coulter Counter Model TA II" (Trademark), made by Coulter Electronics Limited, to which there are attached (a) an interface (made by Nikkaki Co., Ltd.) capable of outputting a particle size distribution by number and a particle size distribution by volume, and (b) a personal computer "PC9801", made by NEC Corporation are connected.

As an electrolysis solution, a 1% aqueous solution of sodium chloride is prepared, using a first class grade chemical of NaCl.

To 10 to 15 ml of the above prepared electrolysis solution, 0.1 to 5 ml of a surfactant, preferably alkylbenzene sulfonate, serving as a dispersant, is added. Thereafter, 2 to 20 mg of a sample (toner particles) is added. The thus prepared mixture is then subjected to ultrasonic dispersion process for about 1 to 3 minutes.

The thus prepared dispersion is added to 100 to 200 ml of a 1% aqueous solution of sodium chloride which is separately prepared and placed in a beaker, whereby a sample dispersion with a predetermined concentration is obtained.

By use of the above-mentioned "Coulter Counter Model TA II" provided with 100 $\mu$m apertures, the particle size distribution by number of particles with a particle diameter ranging from 2 to 40 $\mu$m is measured, whereby the particle size distribution by volume and the particle size distribution by number are calculated with respect to the 2 to 40 $\mu$m particles, and a weight-average particle diameter on the basis of weight (D4: a central value of each channel is made a representative value of each channel) is determined, which is determined from the particle size distribution by volume.

In preparing the two-component developer of the present invention, it is preferable to add an inorganic powder as a fluidity-improving agent to the toner. In the toner having such particle size distribution as specified in the present invention, the specific surface area of the toner is smaller than that of the conventional toner. Therefore, when the toner of the present invention is mixed with the magnetic carrier to use the mixture as a two-component developer, the number of the contacts of the toner particles with the carrier particles is smaller than that in the case of the conventional two-component developer As a result, the surface of the carrier particles can be prevented from being contaminated with the toner, and the toner particles can be prevented from being abraded and crushed.

Further, in accordance with the decrease in the specific surface area of the toner, the amount of the inorganic powder to be added to the toner as the fluidity-improving agent can be decreased, so that there can be minimized the occurrence of the problems that the photoconductor is contaminated with the inorganic powder, the filming phenomenon takes place, and the image fixing is impaired. Accordingly the life of the developer and that of the photoconductor can be extended.

The effects of the toner particles with a number-average particle diameter ranging from D25 to D75, which play a significant role can be further intensified in the presence of a small amount of the inorganic powder, and therefore high quality images can be provided in a stable manner for an extended period of time.

Examples of the inorganic powder serving as the fluidity improving agent for use in the present invention are oxides and composite oxides comprising Si, Ti, Al, Mg, Ca, Sr, Ba, In, Ga, Ni, Mn, W, Fe, Co, Zn, Cr, Mo, Cu, Ag, V, and Zr are useful. Of these inorganic powders, powders of silicon dioxide (silica), titanium dioxide (titania) and aluminum oxide (alumina) are particularly preferable for use in the present invention.

Further, the above-mentioned inorganic powders may be surface-treated to make them hydrophobic.

Representative examples of surface treatment agents for making the inorganic powders are as follows: dimethyldichlorosilane, trimehtylchlorosilane, methyltrichlorosilane, allyldimethyldichlorosilane, allylphenyldichlorosilane, benzyldimethylchlorosilane, bromomethyldimethylchlorosilane, α-chloroethyltrichlorosilane, p-chloroethyltrichlorosilane, chloromethyldimethylchlorosilane, chloromethyltrichlorosilane, p-chlorophenyltrichlorosilane, 3-chloropropyltrichlorosilane, 3-chloropropyltrimethoxysilane, vinyltriethoxysilane, vinylmethoxysilane, vinyl-tris(β-methoxyethoxy)silane, γ-methacryloxypropyl-trimethoxysilane, vinyltriacetoxysilane, divinyldichlorosilane, dimethylvinylchlorosilane, octyl-trichlorosilane, decyl-trichlorosilane, nonyl-trichlorosilane, (4-t-propylphenyl)-trichlorosilane, (4-t-butylphenyl)-trichlorosilane, dipentyl-dichlorosilane, dihexyl-dichlorosilane, dioctyl-dichlorosilane, dinonyl-dichlorosilane, didecyl-dichlorosilane, didodecyl-dichlorosilane, dihexadecyl-dichlorosilane, (4-t-butylphenyl)-octyl-dichlorosilane, dioctyl-dichlorosilane, didecyl-dichlorosilane, dinonenyl-dichlorosilane, di-2-ethylhexyl-dichlorosilane, di-3,3-dimethylpentyl-dichlorosilane, trihexyl-chlorosilane, trioctyl-chlorosilane, tridecyl-chlorosilane, dioctyl-methyl-chlorosilane, octyl-dimethyl-chlorosilane, (4-t-propylphenyl)-diethyl-chlorosilane, octyltrimethoxysilane, hexamethyldisilazane, hexaethyldisilazane, diethyltetramethyldisilazane, hexaphenyldisilazane, and hexatolyldisilazane. In addition, a titanate based coupling agent and an aluminum based coupling agent can also be employed.

It is preferable that the amount of the inorganic powder be in the range of 0.3 to 1.5 wt % of the entire weight of the toner. When the amount of the inorganic powder is less than 0.3 wt %, aggregation of toner particles cannot be effectively prevented. When the amount of the inorganic powder exceeds 1.5 wt %, the toner particles tend to scatter between thin line images, the inside of the image forming apparatus tends to be stained with the toner particles, and the photoconductor is easily scratched or abraded with the inorganic powder.

One of the features of the present invention is that even though the amount of the inorganic powder added is small, the predetermined fluidity of toner can be ensured, and high image quality and high resolution can be maintained when a large number of copies or printings are made for a long period of time.

The above effects obtained in the present invention are far more profound than the case where the amount of the toner particles with a particle diameter of 5 $\mu$m or less is increased and a large quantity of the inorganic powder is added.

The inorganic powders are effective for preventing excessive charging and aggregation of toner particles. In the case of finely-divided silica particles, it is preferable that the BET specific surface area thereof be in the range of 20 $m^2/g$ to 200 $m^2/g$, more preferably in the range of 40 $m^2/g$ to 150 $m^2/g$; in the case of finely-divided titania particles, it is preferable that the BET specific surface area thereof be in the range of 30 $m^2/g$ to 210 $m^2/g$, more preferably in the range of 50 $m^2/g$ to 160 $m^2/g$; and in the case of finely-divided alumina particles, it is preferable that the BET specific surface area thereof be in the range of 40 $m^2/g$ to 220 $m^2/g$, more preferably in the range of 60 $m^2/g$ to 160 $m^2/g$.

In the case of finely-divided silica particles, when the specific surface area thereof exceeds 200 $m^2/g$, in the case of finely-divided titania particles, when the specific surface area thereof exceeds 210 $m^2/g$, and in the case of finely-divided alumina particles, when the specific surface area thereof exceeds 220 $m^2/g$, the fluidity improving effects thereof will be increased. However, when the above finely-divided inorganic particles with the above large specific surface areas are used, the toner tends to deteriorate because of the hydrophilic property thereof, so that the charge quantity of the toner particles may be changed by use of the above finely-divided inorganic particles with the above large specific surface areas.

In contrast to the above, in the case of finely-divided silica particles, when the specific surface area thereof is less than 20 $m^2/g$ in the case of finely-divided titania particles, when the specific surface area thereof is less than 30 $m^2/g$, and in the case of finely-divided alumina particles, when the specific surface area thereof is 40 $m^2/g$, the fluidity improving effects thereof is insufficient for supplying the toner in a stable manner, and furthermore, the particle diameter thereof is so large that there is the risk that the surface of the photoconductor is scratched or abraded.

To the two-component developer of the present invention, there may be added other additives in a small amount as long as they have adverse effects on the developer. There can be employed as a lubricant such as finely-divided particles of Teflon, zinc stearate, and polyvinylidene fluoride; an abrasive such as finely-divided particles of cerium oxide, silicon carbide and strontium titanate; an electroconductivity imparting agent such as finely-divided particles of carbon black, zinc oxide and tin oxide; and an agent for improving development performance such as finely-divided white powders and black powders, each having a polarity opposite to that of the toner.

As the binder resin for use in the toner of the present, any binder resins for use conventional toners can be employed. For instance, a vinyl resin, a polyester resin, and a polyol resin can be preferably employed as the binder resin.

Specific examples of the vinyl resin used as the binder resin for use in the toner include homopolymers of styrene and substituted styrenes such as polystyrene, poly-p-chlorostyrene, and polyvinyltoluene; styrene-based copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinylmethyl ether copolymer, styrene-vinylethyl ether copolymer, styrene-vinylmethyl ketone copolymer, styrene-butadiene copolymer, styrene-isoprene copolymer, styrene-acrylonitrile-indene copolymer, styrene-maleic acid copolymer, and styrene-maleic acid ester copolymer; and poly(methyl methacrylate), poly(butyl methacrylate), polyvinyl chloride, and polyvinyl acetate.

The polyester resin serving as the binder resin for in the present invention can be prepared from a dihydroxy alcohol component (a) selected from the following group A and a dibasic acid component (b) selected from the following group B. Furthermore, a polyhydric alcohol having three or more hydroxyl groups, or a polycarboxylic acid having three or more carboxyl groups selected from the following group C may be added to the above-mentioned components (a) and (b).

Group A: ethylene glycol, triethylene glycol, 1,2-propylene glycol, 1,3-propylene glycol, 1,4-butanediol, neopentyl glycol, 1,4-butenediol, 1,4-bis(hydroxymethyl) cyclohexane, bisphenol A, hydrogenated bisphenol A, a reaction product of polyoxyethylene and bisphenol A, polyoxypropylene(2,2)-2,2'-bis(4-hydroxyphenyl)propane, polyoxypropylene(3,3)-2,2-bis(4-hydroxyphenyl)propane, polyoxyethylene(2,0)-2,2-bis(4-hydroxyphenyl)propane, and polyoxypropylene(2,0)-2,2'-bis(4-hydroxyphenyl) propane.

Group B: maleic acid, fumaric acid, mesaconic acid, citraconic acid, itaconic acid, glutaconic acid, phthalic acid, isophthalic acid, terephthalic acid, cyclohexane-dicarboxylic acid, succinic acid, adipic acid, sebacic acid, malonic acid, linolenic acid; anhydrides of the above acids; and esters of the above acids and a lower alcohol.

Group C: polyhydric alcohols having three or more hydroxyl groups, such as glycerin, trimethylolpropane, and pentaerythritol; and polycarboxylic acids having three or more carboxyl groups, such as trimellitic acid and pyromellitic acid.

The polyol resin, which is preferably used as the binder resin for in the toner of the present invention, is prepared by allowing the following components to react: (1) an epoxy resin, (2) an alkylene oxide adduct of a dihydric phenol or a glycidyl ether of the alkylene oxide adduct; (3) a compound having in the molecule thereof one active hydrogen atom which is capable of reacting with epoxy group; and (4) a compound having in the molecule thereof two or more active hydrogen atoms which are capable of reacting with epoxy group.

The above-mentioned resins may be used together with other resins, for example, epoxy resin, polyamide resin, urethane resin, phenolic resin, butyral resin, rosin, modified rosin, and terpene resin when necessary.

As the aforementioned epoxy resin for use in the present invention, a polycondensation product of a bisphenol such as bisphenol A or bisphenol F and epichlorohydrin is a representative example.

As the coloring agent for use in the toner of the present invention, the following pigments can be employed.

Examples of the black coloring agent are carbon black, oil furnace black, channel black, lamp back, acetylene black, Azine dyes such as aniline black, metallic salt azo dyes, metallic oxides, and composite metallic oxides.

Examples of the yellow pigment are Cadmium Yellow, Mineral Fast Yellow, Nickel Titan Yellow, Naples Yellow, Naphthol Yellow S, Hansa Yellow G, Hansa Yellow 10G, Benzidine Yellow GR, Quinoline Yellow Lake, Permanent Yellow NCG, and Tartrazine Lake.

Examples of the orange pigment are Molybdate Orange, Permanent Orange GTR, Pyrazolone Orange, Vulcan Orange, Indanthrene Brilliant Orange RK, Benzidine Orange G, and Indanthrene Brilliant Orange GK.

Examples of the red pigment are red iron oxide, Cadmium Red, Permanent Red 4R, Lithol Red, Pyrazolone Red, Watchung Red Calcium Salt, Lake Red D, Brilliant Carmine 6B, Eosine Lake, Rhodamine Lake B, Alizarine Lake, and Brilliant Carmine 3B.

Examples of the purple pigment are Fast Violet B and Methyl Violet Lake.

Examples of the blue pigment are Cobalt Blue, Alkali Blue, Victoria Blue Lake, Phthalocyanine Blue, metal-free Phthalocyanine Blue, Phthalocyanine Blue partially chlorinated, Fast Sky Blue and Indanthrene Blue BC.

Examples of the green pigment are Chrome Green, chromium oxide, Pigment Green B, and Malachite Green Lake.

These pigments can be employed alone or in combination.

Furthermore, to the toner of the present invention, a releasing agent for preventing the off-set phenomenon in the image fixing process can be internally added. Examples of the releasing agent include natural waxes such as candelilla wax, carnauba wax, and rice wax; montan wax, paraffin wax, sazol wax, low-molecular-weight polyethylene, low-molecular-weight polypropylene, and alkyl phosphate. From these releasing agents, an appropriate releasing agent can be selected in accordance with the kind of binder resin used in the toner and the kind of material used for the surface portion of the image fixing roller. It is preferable that the releasing agent have a melting point in the range of 65 to 90° C. When the melting point of the releasing agent is lower than 65° C., blocking of toner particles tends to occur during the storage thereof, while when the melting point of the releasing agent is higher than 90° C., the off-set phenomenon tends to easily take place when the image fixing roller is in a low temperature region.

The two-component developer according to the present invention may further comprise a charge control agent. The charge control agent may be incorporated in the toner particles (internal addition), or may be mixed with the toner particles (external addition). By use of the charge control agent, the charge quantity of toner can be appropriately controlled in accordance with a development system employed. In particular, in the present invention, by the addition of the charge control agent, the balance between the charge quantity of the toner particles and the particle size distribution thereof can be further more stabilized.

Specific examples of positive charge control agents for controlling the charging of the toner to a positive polarity are nigrosine, quaternary ammonium salts, and imidazole metal complexes and salts thereof; and specific examples of negative charge control agents for controlling the charging of the toner to a negative polarity are salicylic acid metal complexes and salts thereof, organic boron salts, and calixarene compounds.

With respect to the carrier for use in the two-component developer of the present invention, there can be used any materials for the conventional carriers. For example, magnetic particles such as magnetic powders such as iron powder, ferrite powder, nickel powder, and magnetite powder, and these magnetic particles may be surface-treated with a fluorine-based resin, vinyl resin or silicone resin. In addition, magnetic particles dispersed in a resin particles can also be employed as the carrier particles. It is preferable that the average particle diameter of the magnetic carrier particles be in the range of 35 to 75 $\mu$m.

The toner for use in the present invention can be prepared, for example, by sufficiently mixing the above-mentioned binder resin, pigment or dye serving as the coloring agent, charge control agent, lubricant, and other additives using a mixer such as a Henschel mixer, and thoroughly kneading the mixture.

As the kneading apparatus for kneading the above mixture, the following kneaders can be employed: a batch-type two-roll mixer, Banburry's mixer, a continuous double screw extruder such as a KTK type double screw extruder made by Kobe Steel, Ltd., a TEM type double screw extruder made by Toshiba Machine Co., Ltd., a double screw extruder made by KCK Co., Ltd., a PCM type double screw extruder made by Ikegai Tekko Co., Ltd., a KEX type double screw extruder made by Kurimoto, Ltd., and a continuous single screw kneader, for example, Continuous Kneader made by Buss Co., Ltd.

After the thus kneaded mixture is cooled, the mixture is coarsely crushed by a hammer mill or like, and thereafter finely pulverized by means of a pulverizer using jet air stream or a mechanical pulverizer, and classified to obtain a predetermined particle diameter using a rotary air classifier or a classifier utilizing a Coanda effect.

Then, the classified particles are sufficiently mixed with the above-mentioned finely-divided inorganic particles in a mixer such as a Henschel mixer, and the obtained particles are caused to pass through a screen with 250-mesh or more to remove the coarse particles and the aggregated particles. Thus, a toner for use in the present invention is obtained. Further, the thus obtained toner and the above-mentioned magnetic carrier are mixed at a predetermined mixing ratio, whereby a two-component developer of the present invention is obtained.

The two-component developer of the present invention is used for image formation by electrophotography, and is usually held in a container such as a bottle, a cartridge, or other conventional vessels, and is on the market. The user generally uses the developer by attaching the developer-containing container to an image formation apparatus.

Other features of this invention will become apparent in the course of the following description of exemplary embodiments, which are given for illustration of the invention and are not intended to be limiting thereof.

EXAMPLE 1

The following components were sufficiently mixed in a mixer.

| | Parts by Weight |
|---|---|
| Binder resin: polyester resin | 100 |
| Coloring agent: carbon black | 10 |
| Charge control agent: zinc salicylate | 5 |
| Releasing agent: low-molecular-weight polyethylene | 5 |

The resultant mixture was fused and kneaded at 120° C. using a double-screw extruder. After the kneaded mixture was rolled and cooled, the mixture was coarsely crushed by a cutter mill and finely pulverized by means of a pulverizer using jet air stream.

Thereafter, the particles were subjected to air classification by use of a gyratory air classifier so as to obtain matrix toner particles with such particle size distribution that the toner particles with a particle diameter of 5 $\mu$m or less were contained with a content ratio of 15% by number, and that the toner particles with such a particle diameter that was two times or greater than the weight-average particle diameter of the toner particles were contained with a content ratio of 4.3% by volume, with D25/D75=0.63, wherein D25 is a number-average particle diameter when the toner particles reach a cumulative particle number of 25% in a cumulative undersize particle number distribution thereof, and D75 is a number-average particle diameter when the toner particles reach a cumulative particle number of 75% in a cumulative undersize particle number distribution.

100 parts by weight of the matrix toner particles were mixed with 0.3 parts by weight of hydrophobic silica particles with a specific surface area of 188 $m^2/g$ in a Henschel mixer, whereby a toner (1) for use in the present invention was obtained.

TABLE 1 shows the particle size distribution of the thus obtained toner (1).

TABLE 2 shows the loose bulk density and aggregation ratio of the toner measured for evaluation of the fluidity of the toner (1).

The loose bulk density was measured using a commercially available powder tester (Trademark "Powder Tester PT-N", made by Hosokawa Micron Corporation). The loose bulk density was measured by causing the toner particles to pass through a 250-mesh screen and collecting the portion of the toner particles that passed through the screen in a cup, weighing the collected portion.

The aggregation ratio of the toner was measured, using the "Powder Tester PT-N", made by Hosokawa Micron Corporation, by subjecting the toner particles to screening using 150-$\mu$m mesh, 75-$\mu$m mesh, and 45-$\mu$m mesh screens, with the application of vibrations for 60 sec. T The aggregation ratio was calculated in accordance with the following formula:

Aggregation (%)=((the amount of 150 $\mu$m oversize particles)+3×(the amount of 75 $\mu$m oversize particles)/5+(the amount of 45 $\mu$m oversize particles)/5)×50

2.5 parts by weight of the toner (1) were mixed with 97.5 parts by weight of carrier particles prepared by coating ferrite particles with a silicone resin, whereby a two-component developer No. 1 of the present invention was obtained.

For the evaluation of the image fixing performance of the thus obtained two-component developer No. 1, the developer was incorporated in a commercially available copying apparatus (Trademark "imagio DA505", made by Ricoh Company, Ltd.), which was equipped with an organic photoconductor drum as a latent image bearing member, and a cleaning blade as cleaning means.

More specifically, the image fixing performance of the two-component developer No. 1 was evaluated by fixing a solid image at a central temperature of a designated image fixing temperature, and fixing another solid image at a temperature which was lower than the central temperature by 30° C.

The fixed solid images were scratched with application of a load of 50 g by use of a drawing tester made by Ueshima Co., Ltd., and the scratched marks on the fixed solid images were evaluated with a scale including ranks 1 to 5. The large the number of the rank, the better the image fixing performance. Rank 3 is such a rank that cannot be used in practice because the fixed image becomes easily peeled off, when rubbed with a rubber eraser.

A running test of making 120,000 copies was conducted to see whether or not improper cleaning and the toner filming take place to evaluate the two-component developer No. 1. Furthermore, the formed images were also evaluated with respect to the image resolution thereof with a scale including ranks 1 to 5, using Standard S-3 test chart for image evaluation, by observing the resolving power for thin line images with a magnifying lens. The larger the number of the rank, the greater the resolving power for thin line images, thereby obtaining images with high resolution.

The results of the above evaluation are shown in TABLE 2.

EXAMPLE 2

100 parts by weight of the matrix toner particles prepared in Example 1 were mixed with 0.3 parts by weight of hydrophobic silica particles with a specific surface area of 136 $m^2/g$ in a Henschel mixer, whereby a toner (2) for use in the present invention was obtained.

The thus prepared toner (2) was evaluated in the same manner as in Example 1. The results are shown in TABLES 1 and 2.

2.5 parts by weight of the toner (2) were mixed with 97.5 parts by weight of carrier particles prepared by coating ferrite particles with a silicone resin in the same manner as in Example 1, whereby a two-component developer No. 2 of the present invention was obtained.

The thus prepared two-component developer No. 2 of the present invention was evaluated in the same manner as in Example 1. The results are shown in TABLE 2.

EXAMPLE 3

100 parts by weight of the matrix toner particles prepared in Example 1 were mixed with 0.3 parts by weight of titanium oxide particles with a specific surface area of 144 $m^2/g$ in a Henschel mixer, whereby a toner (3) for use in the present invention was obtained.

The thus prepared toner (3) was evaluated in the same manner as in Example 1. The results are shown in TABLES 1 and 2.

2.5 parts by weight of the toner (3) were mixed with 97.5 parts by weight of carrier particles prepared by coating ferrite particles with a silicone resin in the same manner as in Example 1, whereby a two-component developer No. 3 of the present invention was obtained.

The thus prepared two-component developer No. 3 of the present invention was evaluated in the same manner as in Example 1. The results are shown in TABLE 2.

EXAMPLE 4

100 parts by weight of the matrix toner particles prepared in Example 1 were mixed with 0.3 parts by weight of alumina particles with a specific surface area of 152 $m^2/g$ in a Henschel mixer, whereby a toner (4) for use in the present invention was obtained.

The thus prepared toner (4) was evaluated in the same manner as in Example 1. The results are shown in TABLES 1 and 2.

2.5 parts by weight of the toner (4) were mixed with 97.5 parts by weight of carrier particles prepared by coating ferrite particles with a silicone resin in the same manner as in Example 1, whereby a two-component developer No. 4 of the present invention was obtained.

The thus prepared two-component developer No. 4 of the present invention was evaluated in the same manner as in Example 1. The results are shown in TABLE 2.

EXAMPLE 5

The same procedure for preparing the matrix toner particles as in Example 1 was repeated except that the classification conditions therefor were changed so as to obtain matrix toner particles with such particle size distribution that the toner particles with a particle diameter of 5 μm or less were contained with a content ratio of 7.2% by number, and that the toner particles with such a particle diameter that was two times or greater than the weight-average particle diameter of the toner particles were contained with a content ratio of 0.3% by volume, with D25/D75=0.82.

100 parts by weight of the matrix toner particles were mixed with 0.5 parts by weight of hydrophobic silica particles with a specific surface area of 188 $m^2/g$ in a Henschel mixer, whereby a toner (5) for use in the present invention was obtained.

TABLE 1 shows the particle size distribution of the thus obtained toner (5).

2.5 parts by weight of the toner (5) were mixed with 97.5 parts by weight of carrier particles prepared by coating ferrite particles with a silicone resin in the same manner as in Example 1, whereby a two-component developer No. 5 of the present invention was obtained.

The thus prepared two-component developer No. 5 of the present invention was evaluated in the same manner as in Example 1. The results are shown in TABLE 2.

Comparative Example 1

The same procedure for preparing the matrix toner particles as in Example 1 was repeated except that the classification conditions therefor were changed so as to obtain matrix toner particles with such particle size distribution that the toner particles with a particle diameter of 5 μm or less were contained with a content ratio of 70% by number, and that the toner particles with such a particle diameter that was two times or greater than the weight-average particle diameter of the toner particles were contained with a content ratio of 0.3% by volume, with D25/D75=0.67.

100 parts by weight of the matrix toner particles were mixed with 1.0 part by weight of hydrophobic silica particles with a specific surface area of 188 $m^2/g$ in a Henschel mixer, whereby a comparative toner (1) was obtained.

TABLE 1 shows the particle size distribution of the thus obtained comparative toner (1).

2.5 parts by weight of the comparative toner (1) were mixed with 97.5 parts by weight of carrier particles prepared by coating ferrite particles with a silicone resin in the same manner as in Example 1, whereby a comparative two-component developer No. 1 was obtained.

The thus prepared comparative two-component developer No. 1 was evaluated in the same manner as in Example 1. The results are shown in TABLE 2.

Comparative Example 2

The same procedure for preparing the matrix toner particles as in Example 1 was repeated except that the classification conditions therefor were changed so as to obtain matrix toner particles with such particle size distribution that the toner particles with a particle diameter of 5 μm or less were contained with a content ratio of 14.6% by number, and that the toner particles with such a particle diameter that was two times or greater than the weight-average particle diameter of the toner particles were contained with a content ratio of 8.1% by volume, with D25/D75=0.72.

100 parts by weight of the matrix toner particles were mixed with 0.3 parts by weight of hydrophobic silica particles with a specific surface area of 188 $m^2/g$ in a Henschel mixer, whereby a comparative toner (2) was obtained.

TABLE 1 shows the particle size distribution of the thus obtained comparative toner (2).

2.5 parts by weight of the comparative toner (2) were mixed with 97.5 parts by weight of carrier particles prepared by coating ferrite particles with a silicone resin in the same manner as in Example 1, whereby a comparative two-component developer No. 2 was obtained.

The thus prepared comparative two-component developer No. 2 was evaluated in the same manner as in Example 1. The results are shown in TABLE 2.

Comparative Example 3

The same procedure for preparing the matrix toner particles as in Example 1 was repeated except that the classification conditions therefor were changed so as to obtain matrix toner particles with such particle size distribution that the toner particles with a particle diameter of 5 μm or less were contained with a content ratio of 15.5% by number, and that the toner particles with such a particle diameter that was two times or greater than the weight-average particle diameter of the toner particles were contained with a content ratio of 0.7% by volume, with D25/D75=0.59.

100 parts by weight of the matrix toner particles were mixed with 0.3 parts by weight of hydrophobic silica particles with a specific surface area of 188 $m^2/g$ in a Henschel mixer, whereby a comparative toner (3) was obtained.

TABLE 1 shows the particle size distribution of the thus obtained comparative toner (3).

2.5 parts by weight of the comparative toner (3) were mixed with 97.5 parts by weight of carrier particles prepared by coating ferrite particles with a silicone resin in the same manner as in Example 1, whereby a comparative two-component developer No. 3 was obtained.

The thus prepared comparative two-component developer No. 3 was evaluated in the same manner as in Example 1. The results are shown in TABLE 2.

Comparative Example 4

The same procedure for preparing the matrix toner particles as in Example 1 was repeated except that the classification conditions therefor were changed so as to obtain matrix toner particles with such particle size distribution that the toner particles with a particle diameter of 5 μm or less were contained with a content ratio of 0.3% by number, and that the toner particles with such a particle diameter that was two times or greater than the weight-average particle diameter of the toner particles were contained with a content ratio of 0% by volume, with D25/D75=0.87.

100 parts by weight of the matrix toner particles were mixed with 0.3 parts by weight of hydrophobic silica particles with a specific surface area of 188 $m^2/g$ in a Henschel mixer, whereby a comparative toner (4) was obtained.

TABLE 1 shows the particle size distribution of the thus obtained comparative toner (4).

2.5 parts by weight of the comparative toner (4) were mixed with 97.5 parts by weight of carrier particles prepared by coating ferrite particles with a silicone resin in the same manner as in Example 1, whereby a comparative two-component developer No. 4 was obtained.

The thus prepared comparative two-component developer No. 4 was evaluated in the same manner as in Example 1. The results are shown in TABLE 2.

TABLE 1

| | Weight-average particle diameter of toner particles | Content ratio (%) by number of toner particles (a)* | D25/D75 | Content ratio (%) by volume of toner particles (b)** | Inorganic powder | Amount of inorganic powder (parts by weight) | BET specific surface area of inorganic powder ($m^2/g$) | Average particle diameter of carrier particles ($\mu m$) | Yield (%) of toner produced |
|---|---|---|---|---|---|---|---|---|---|
| Ex. 1 | 9.93 | 15 | 0.63 | 4.3 | silica | 0.3 | 188 | 50 | 83 |
| Ex. 2 | 9.93 | 15 | 0.63 | 4.3 | silica | 0.3 | 136 | 50 | 83 |
| EX. 3 | 9.93 | 15 | 0.63 | 4.3 | titania | 0.3 | 144 | 50 | 83 |
| Ex. 4 | 9.93 | 15 | 0.63 | 4.3 | alumina | 0.3 | 152 | 50 | 83 |
| Ex. 5 | 8.38 | 7.2 | 0.82 | 0.3 | silica | 0.5 | 188 | 50 | 77 |
| Comp. Ex. 1 | 5.38 | 70 | 0.67 | 0.3 | silica | 1 | 188 | 50 | 91 |
| Comp. Ex. 2 | 10.01 | 14.6 | 0.72 | 8.1 | silica | 0.3 | 188 | 50 | 83 |
| Comp. Ex. 3 | 10.34 | 15 | 0.59 | 0.7 | silica | 0.3 | 188 | 50 | 80 |
| Comp. Ex. 4 | 8.98 | 0.3 | 0.87 | 0 | silica | 0.3 | 188 | 50 | 21 |

(*) Toner particles (a) having a particle diameter of 5 $\mu m$ or less.
(**) Toner particles (b) having a particle diameter of two times or more the weight-average particle diameter of the entire toner particles.

TABLE 2

| | Fluidity of toner | | Image fixing performance | | After making 100 copies | | After making 1,200,000 copies | | | |
|---|---|---|---|---|---|---|---|---|---|---|
| | Loose bulk density (g/cc) | Aggregation ratio (%) | Image fixing Temp. (1)* Rank | Image fixing Temp. (2)** Rank | Occurrence of defective cleaning | Occurrence of filming of toner | Occurrence of defective cleaning | Occurrence of filming of toner | Scraped thickness of photoconductor ($\mu m$) | Image resolution |
| Ex. 1 | 0.393 | 3.08 | 5 | 4.5 | None | None | None | None | 9.2 | 4.5 |
| Ex. 2 | 0.393 | 3.08 | 5 | 4.5 | None | None | None | None | 10.5 | 5 |
| Ex. 3 | 0.393 | 3.08 | 5 | 4.5 | None | None | None | None | 9.5 | 5 |
| Ex. 4 | 0.393 | 3.08 | 5 | 4.5 | None | None | None | None | 11.3 | 5 |
| Ex. 5 | 0.381 | 3.17 | 5 | 4.5 | None | None | None | None | 11.3 | 5 |
| Comp. Ex. 1 | 0.272 | 30.13 | 4 | 3 | None | None | Slightly observed | Slightly observed | 15.2 | 4 |
| Comp. Ex. 2 | 0.394 | 3.07 | 5 | 4.5 | None | None | Slightly observed | None | 12.8 | 4 |
| Comp. Ex. 3 | 0.392 | 3.08 | 5 | 4.5 | None | None | None | None | 10.2 | 3.5 |
| Comp. Ex. 4 | 0.38 | 2.95 | 5 | 4.5 | None | None | Slightly observed | Slightly observed | 10.7 | 4.5 |

(*) Image fixing temperature (1) is a designated image fixing temperature of a copying machine.
(**) Image fixing temperature (2) is lower than the image fixing temperature (1) by 30 ° C.

Japanese Patent Application No. 11-150087 filed May 28, 1999 is hereby incorporated by reference.

What is claimed is:

1. A two-component developer comprising at least a magnetic carrier and a toner wherein:

said magnetic carrier comprises magnetic carrier particles with an average particle diameter of 35 $\mu m$ to 100 $\mu m$, and said toner comprises toner particles with a weight-average particle diameter of 6.0 $\mu m$ to 11.5 $\mu m$, to which at least one additive is externally added thereto in an amount of 0.3 to 1.5 wt. % to said toner, said toner particles comprising (a) toner particles with a particle diameter of 5 $\mu m$ or less with a content ratio of 15% or less by number, and (b) toner particles with such a particle diameter that is two times or greater than the weight-average particle diameter of said toner particles with a content ratio of 5% or less by volume, said toner particles satisfying a relationship of $0.60 \leqq D25/D75 \leqq 0.85$, wherein D25 is a number-average particle diameter when said toner particles reach a cumulative particle number of 25% in a cumulative undersize particle number distribution thereof, and D75 is a number-average particle diameter when said toner particles reach a cumulative particle number of 75% in a cumulative undersize particle number distribution.

2. The two-component developer as claimed in claim 1, wherein said additive comprises at least one component selected from the group consisting of silica particles, titania particles, and alumina particles.

3. The two-component developer as claimed in claim 1, wherein said toner comprises toner particles with a weight-average particle diameter of 7.5 $\mu m$ to 10.5 $\mu m$, said toner particles comprising (a) said toner particles with a particle diameter of 5 μm or less with a content ratio of 15% or less by number, and (b) said toner particles with such a particle diameter that is two times or greater than the weight-average particle diameter of said toner particles with a content ratio of 3% or less by volume, said toner particles satisfying a relationship of $0.70 \leqq D25/D75 \leqq 0.85$, wherein D25 is a number-average particle diameter when said toner particles reach a cumulative particle number of 25% in a cumulative undersize particle number distribution thereof, and D75 is a number-average particle diameter when said toner particles reach a cumulative particle number of 75% in a cumulative undersize particle number distribution.

4. The two-component developer as claimed in claim 3, wherein said additive comprises at least one component selected from the group consisting of silica particles, titania particles, and alumina particles.

5. The two-component developer as claimed in claim 2, wherein said silica particles have a BET specific surface area of 20 $m^2/g$ to 200 $m^2/g$.

6. The two-component developer as claimed in claim 4, wherein said silica particles have a BET specific surface area of 20 $m^2/g$ to 200 $m^2/g$.

7. The two-component developer as claimed in claim 2, wherein said titania particles have a BET specific surface area of 30 $m^2/g$ to 210 $m^2/g$.

8. The two-component developer as claimed in claim 4, wherein said titania particles have a BET specific surface area of 30 $m^2/g$ to 210 $m^2/g$.

9. The two-component developer as claimed in claim 2, wherein said alumina particles have a BET specific surface area of 40 $m^2/g$ to 220 $m^2/g$.

10. The two-component developer as claimed in claim 4, wherein said alumina particles have a BET specific surface area of 40 $m^2/g$ to 220 $m^2/g$.

11. A container in which there is held a two-component developer which comprises at least a magnetic carrier and a toner wherein:

said magnetic carrier comprises magnetic carrier particles with an average particle diameter of 35 μm to 100 μm, and said toner comprises toner particles with a weight-average particle diameter of 6.0 μm to 11.5 μm, to which at least one additive is externally added thereto in an amount of 0.3 to 1.5 wt. % to said toner, said toner particles comprising (a) toner particles with a particle diameter of 5 μm or less with a content ratio of 15% or less by number, and (b) toner particles with such a particle diameter that is two times or greater than the weight-average particle diameter of said toner particles with a content ratio of 5% or less by volume, said toner particles satisfying a relationship of $0.60 \leqq D25/D75 \leqq 0.85$, wherein D25 is a number-average particle diameter when said toner particles reach a cumulative particle number of 25% in a cumulative undersize particle number distribution thereof, and D75 is a number-average particle diameter when said toner particles reach a cumulative particle number of 75% in a cumulative undersize particle number distribution.

12. An electrophotographic image formation apparatus in which a container is incorporated, said container holding therein a two-component developer which comprises at least a magnetic carrier and a toner, wherein said magnetic carrier comprises magnetic carrier particles with an average particle diameter of 35 μm to 100 μm, and said toner comprises toner particles with a volume mean diameter of 6.0 μm to 11.5 μm, to which at least one additive is externally added thereto in an amount of 0.3 to 1.5 parts by weight to 100 parts by weight of said toner, said toner particles comprising (a) toner particles with a particle diameter of 5 μm or less in a content ratio of 15% or less by number, and (b) toner particles with such a particle diameter that is two times or greater than the volume mean diameter of said toner particles in a content ratio of 5% or less by volume, said toner particles satisfying a relationship of $0.60 \leqq D25/D75 \leqq 0.85$, wherein D25 is a number-average particle diameter when said toner particles reach a cumulative particle number of 25% in a cumulative undersize particle number distribution thereof, and D75 is a number-average particle diameter when said toner particles reach a cumulative particle number of 75% in a cumulative undersize particle number distribution.

13. A two-component developer for use in an image formation method, in which there is used cleaning means for removing a residual toner from a latent image bearing member after image transfer therefrom, said two-component developer comprising at least a magnetic carrier and a toner wherein:

said magnetic carrier comprises magnetic carrier particles with an average particle diameter of 35 μm to 100 μm, and said toner comprises toner particles with a weight-average particle diameter of 6.0 μm to 11.5 μm, to which at least one additive is externally added thereto in an amount of 0.3 to 1.5 wt. % to said toner, said toner particles comprising (a) toner particles with a particle diameter of 5 μm or less with a content ratio of 15% or less by number, and (b) toner particles with such a particle diameter that is two times or greater than the weight-average particle diameter of said toner particles with a content ratio of 5% or less by volume, said toner particles satisfying a relationship of $0.60 \leqq D25/D75 \leqq 0.85$, wherein D25 is a number-average particle diameter when said toner particles reach a cumulative particle number of 25% in a cumulative undersize particle number distribution thereof, and D75 is a number-average particle diameter when said toner particles reach a cumulative particle number of 75% in a cumulative undersize particle number distribution.

* * * * *

UNITED STATES PATENT AND TRADEMARK OFFICE

CERTIFICATE OF CORRECTION

PATENT NO. : 6,258,502 B1
DATED : July 10, 2001
INVENTOR(S) : Yasushi Nakamura et al.

It is certified that error appears in the above-identified patent and that said Letters Patent is hereby corrected as shown below:

Column 3,
Line 11, "employed However" should read -- employed. However --.
Line 52, "diameter 5" should read -- diameter of 5 --.

Column 8,
Line 67, "screening. sieving" should read -- screening/sieving --.

Column 10,
Line 16, "trimehtychlorosilane" should read -- trimethylchlorosilane --; and
Line 35, "didecyl" should read -- didecenyl --.

Column 15,
Line 61, "large" should read -- larger --.

Signed and Sealed this

Fifth Day of March, 2002

*Attest:*

*Attesting Officer*

JAMES E. ROGAN
*Director of the United States Patent and Trademark Office*